US012480247B2

(12) United States Patent
Zheng et al.

(10) Patent No.: US 12,480,247 B2
(45) Date of Patent: Nov. 25, 2025

(54) CLOTHING CARE MACHINE

(71) Applicant: Tsann Kuen (Zhangzhou) Enterprise Co., Ltd., Fujian (CN)

(72) Inventors: Zhenxing Zheng, Fujian (CN); Ronghuang Chen, Fujian (CN); Ruifeng Cai, Fujian (CN); Xiaodong Xu, Fujian (CN)

(73) Assignee: Tsann Kuen (Zhangzhou) Enterprise Co., Ltd., Zhangzhou (CN)

( * ) Notice: Subject to any disclaimer, the term of this patent is extended or adjusted under 35 U.S.C. 154(b) by 834 days.

(21) Appl. No.: 17/840,991

(22) Filed: Jun. 15, 2022

(65) Prior Publication Data

US 2023/0050171 A1 Feb. 16, 2023

(30) Foreign Application Priority Data

Aug. 13, 2021 (CN) ..... 202110932420.3

(51) Int. Cl.

| | |
|---|---|
| ***D06F 58/14*** | (2006.01) |
| ***D06F 35/00*** | (2006.01) |
| ***D06F 58/26*** | (2006.01) |
| ***D06F 73/00*** | (2006.01) |
| ***D06F 87/00*** | (2006.01) |
| ***E05D 3/06*** | (2006.01) |

(52) U.S. Cl.
CPC ..... *D06F 58/14* (2013.01); *D06F 73/00* (2013.01)

(58) Field of Classification Search
CPC ..... D06F 58/14; D06F 58/26; D06F 58/263; F06F 87/00; F06F 35/00; E05D 3/06; F21V 17/16
See application file for complete search history.

(56) References Cited

FOREIGN PATENT DOCUMENTS

| | | | | |
|---|---|---|---|---|
| CN | 203703855 U | * | 7/2014 | ..... F21V 17/16 |
| CN | 210351324 U | * | 4/2020 | ..... H04N 5/225 |
| CN | 210583135 U | * | 5/2020 | ..... A61J 9/00 |
| KR | 101802505 B1 | * | 11/2017 | ..... D06F 27/08 |
| KR | 102132154 B1 | * | 11/2018 | ..... D06F 58/14 |

OTHER PUBLICATIONS

English translation of CN 203703855 by PE2E Apr. 20, 2025.*
English translation of KR 102132154 by PE2E Apr. 20, 2025.*
English translation of KR101802505 by PE2E Apr. 20, 2025.*
English translation of CN 210351324 by PE2E Apr. 20, 2025.*
English translation of CN210583135 by PE2E, Apr. 20, 2025.*

* cited by examiner

*Primary Examiner* — Deming Wan
(74) *Attorney, Agent, or Firm* — Cooper Legal Group, LLC

(57) ABSTRACT

The present disclosure provides a clothing care machine, including a machine base, a support column, a cloth cover and a top seat. The support column is connected to the machine base at a bottom, and the top seat is connected to a top of the support column. The cloth cover is provided between the machine base and the top seat to form a cavity, and the machine base is provided with a steam outlet and/or a hot air outlet. When in use, the clothes are put into the cavity, and the automatic care of the clothes is realized through the steam output by the steam outlet or the hot air output by the hot air outlet of the machine base. During the process, the user does not need to operate the whole process, saving time and effort.

9 Claims, 9 Drawing Sheets

CLOTHING CARE MACHINE

RELATED APPLICATIONS

The present disclosure claims priority to Chinese Patent Application No. 202110932420.3, filed on Aug. 13, 2021, which is incorporated herein by reference.

TECHNICAL FIELD

The present disclosure relates to the field of daily life, and in particular, to a clothing care machine.

BACKGROUND

In daily life, when clothes need to be worn or stored, they will be treated with tools in advance, such as ironing by an iron. However, some clothes are not suitable for ironing or it is inconvenient to iron with the iron. Therefore, a clothing care machine different from an iron needs to be designed.

SUMMARY

In view of this, the present disclosure provides a clothing care machine in order to solve the above problems.

For achieving the above object, the technical scheme provided by the present disclosure is as follows.

A clothing care machine, comprising a machine base, a support column, a cloth cover and a top seat; a bottom of the support column is connected to the machine base, and the top seat is connected to a top of the support column; the cloth cover is provided between the machine base and the top seat to form a cavity; the machine base is provided with at least one of a steam outlet and a hot air outlet.

In an embodiment, the cloth cover is fixed and sealed to the machine base at a lower end of the cloth cover, and the cloth cover is detachably connected to the top seat at an upper end of the cloth cover.

In an embodiment, the cloth cover is detachably connected to the machine base at a lower end of the cloth cover, and the cloth cover is detachably connected to the top seat at an upper end of the cloth cover.

In an embodiment, the cloth cover comprises a cloth cover body, a lower fixing frame connected to a lower end of the cloth cover body, and an upper fixing frame connected to an upper end of the cloth cover body; the lower fixing frame is fixedly connected to the machine base, and the upper fixing frame is detachably connected to the top seat.

In an embodiment, the cloth cover body is formed by connecting a plurality of cloth cover units end to end, and each end between adjacent cloth cover units is bent inward to form a connection; an upper end of an uppermost cloth cover unit is sewn on the upper fixing frame, and a lower end of a lowermost cloth cover unit is sewn on the lower fixing frame.

In an embodiment, at least one of the plurality of cloth cover units is sewn with a loop of webbing at a middle inside, an annular channel is formed between the loop of webbing and the at least one of the plurality of cloth cover units, and the annular channel is provided with a support frame.

In an embodiment, the cloth cover unit at least includes a waterproof layer located in the inner layer and an outer cover layer located in the outer layer.

In an embodiment, the machine base is recessed with an annular positioning groove; an annular convex rib protrudes from a bottom of the lower fixing frame, and the annular convex rib of the lower fixing frame is sealed and disposed in the annular positioning groove; a fixed connection is also realized between the lower fixing frame and the machine base through a fixing piece.

In an embodiment, the support column is also provided in the cavity; the upper fixing frame is provided with a roller on an inner wall of a corresponding support column.

In an embodiment, the upper fixing frame is distributed with a plurality of snap joints on an outer periphery of the upper fixing frame; the top seat is provided with a plurality of snap sockets; and the upper fixing frame is clamped on the plurality of snap sockets through the plurality of snap joints.

In an embodiment, in the plurality of snap joints, two first elastic snap joints distributed left and right and a plurality of second elastic snap joints distributed front and rear are included; a mating surface of each first elastic snap joint and each snap socket is a flat surface; the each first elastic snap joint is further provided with a reset end extending outward for driving a trip; a mating surface of each second elastic snap joint and the each snap socket is a guide arc surface.

In an embodiment, a bottom of the top seat is provided with a rubber tube, and the upper end of the cloth cover abuts and squeezes the rubber tube to form a sealing fit.

In an embodiment, the cloth cover comprises a cloth cover body, a lower fixing frame sealed to a lower end of the cloth cover body, and an upper fixing frame sealed to an upper end of the cloth cover body; the lower fixing frame is fixed and sealed to the machine base, and the upper fixing frame is detachably connected to the top seat, and forms a sealing fit with the rubber tube.

In an embodiment, the upper fixing frame is distributed with a plurality of snap joints on an outer periphery of the upper fixing frame, the top seat is provided with a plurality of snap sockets, and the upper fixing frame is clamped on the plurality of snap sockets through the plurality of snap joints.

In an embodiment, in the plurality of snap joints, two first elastic snap joints distributed left and right and a plurality of second elastic snap joints distributed front and rear are included; a mating surface of each first elastic snap joint and each snap socket is a flat surface; the each first elastic snap joint also extends outward with a reset end for driving a tripping; a mating surface of each second elastic snap joint and the each snap socket is a guide arc surface.

In an embodiment, the bottom of the top seat has an abutting inner wall with a gradually increasing aperture from top to bottom, and the upper fixing frame has an enlarged outer peripheral mating surface with a gradually increasing aperture from top to bottom; when the upper fixing frame is connected with the top seat, the outer peripheral mating surface is abutted on the abutting inner wall of the top seat.

The technical scheme provided by the present disclosure has the following beneficial effects.

With the clothing care machine, when in use, the clothes are put into the cavity, and the automatic care of the clothes is realized through the steam output by the steam outlet of the machine base and/or the hot air output by the hot air outlet. During the process, the user does not need to operate the whole process, such that time and effort can be saved.

DESCRIPTION OF EMBODIMENTS

Figure 1:
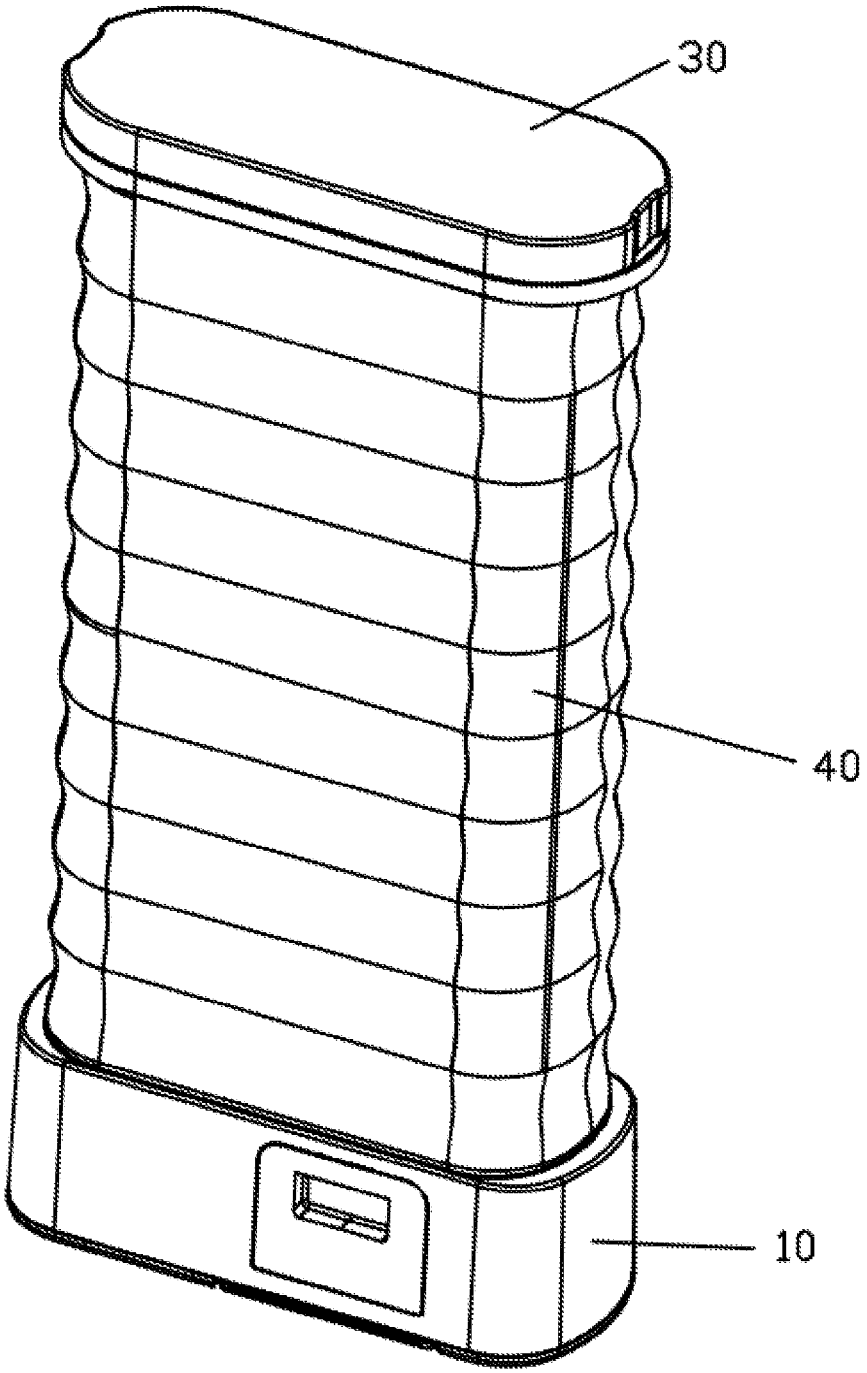
FIG. 1 shows a first perspective view of the clothing care machine in a first state according to an embodiment.
Figure 2:
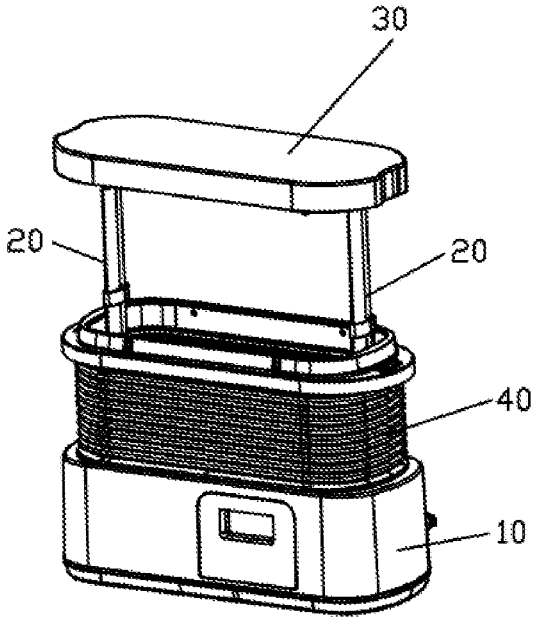
FIG. 2 is a perspective view of the clothing care machine in a second state according to an embodiment.
Figure 3:
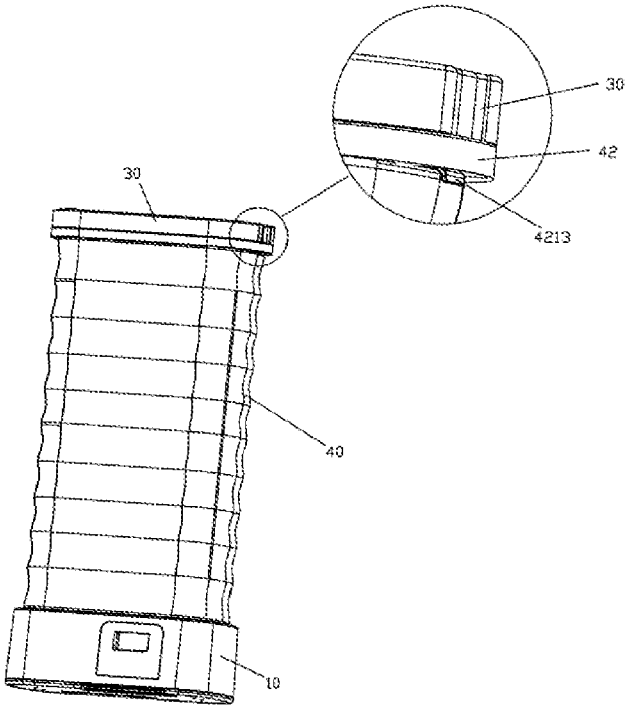
FIG. 3 is a second perspective view of the clothing care machine in the first state according to the embodiment.

To further illustrate the various embodiments, the present disclosure is provided with the accompanying drawings. These drawings are a part of the present disclosure, which are mainly used to illustrate the embodiments, and can be used in conjunction with the relevant description of the specification to explain the operation principles of the embodiments. With reference to this content, one of ordinary skill in the art will understand other possible embodiments and advantages of the present disclosure. Components in the figures are not drawn to scale, and similar component symbols are often used to represent similar components.

The present disclosure will now be further described with reference to the accompanying drawings and specific embodiments.

Embodiment 1

Referring to FIGS. 1 to 5, the present embodiment provides a clothing care machine, including a machine base 10, a support column 20, a cloth cover 40 and a top seat 30. The bottom of the support column 20 may be connected to the machine base 10, the top seat 30 may be connected to the top of the support column 20, and the cloth cover 40 may be provided between the machine base 10 and the top seat 30 to form a cavity. The machine base 10 may be provided with a steam outlet 11 and a hot air outlet 19 communicating with the cavity. When in use, the clothes are put into the cavity, and the automatic care of the clothes can be realized through the cooperation of the steam output by the steam outlet 11 and the hot air output by the hot air outlet 19 of the machine base 10. Specifically, the combination of the steam output from the steam outlet 11 and the hot air output from the hot air outlet 19 may be independent outputs or alternate outputs (e.g., steam output first, then hot air output, etc.). During the process, the user does not need to operate the whole process, but only needs to put the clothes in and out, which saves time and effort.

Figure 4:
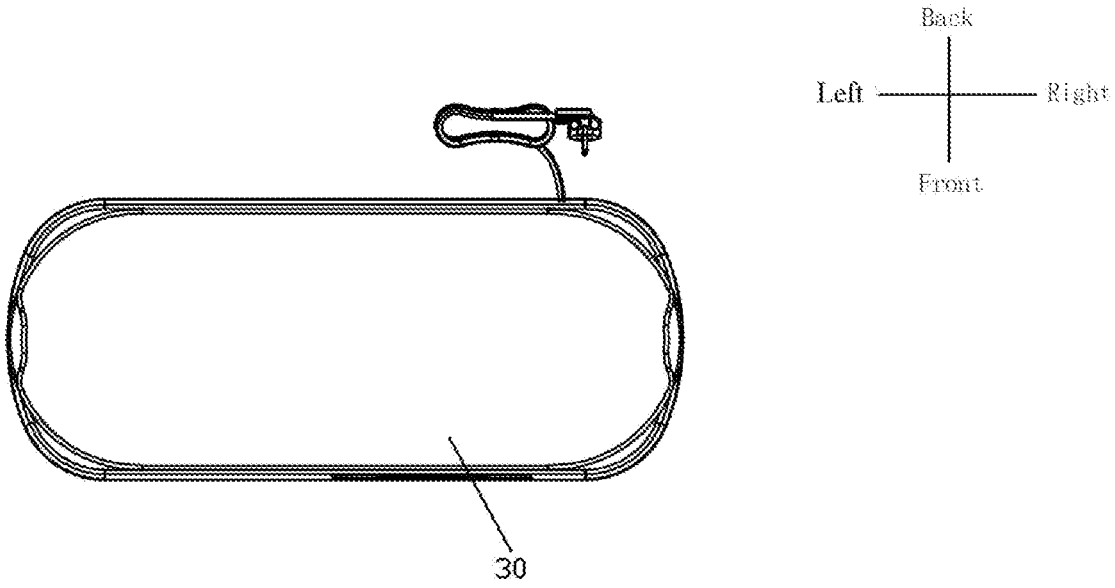
FIG. 4 shows a top view of the clothing care machine according to the embodiment.

Specifically, as shown in FIG. 4, the clothing care machine provided in the present embodiment may have a substantially rectangular shape from a top view. The long side direction is defined as the left-right direction, and the short side direction is defined as the front-rear direction. Of course, in other embodiments, the shape of the clothing care machine is not limited to this.

In the present embodiment, the lower end of the cloth cover 40 may be fixed and sealed to the machine base 10 to prevent leakage, and the upper end of the cloth cover 40 may be detachably connected to the top seat 30. With this arrangement, when it is necessary to take and place clothes, the upper end of the cloth cover 40 may be separated from the top seat 30, and the cloth cover 40 can be moved down as a whole, such that the upper space can be exposed in all directions without any obstruction, and the clothes can be taken and placed better. The operation is easier.

Figure 6:
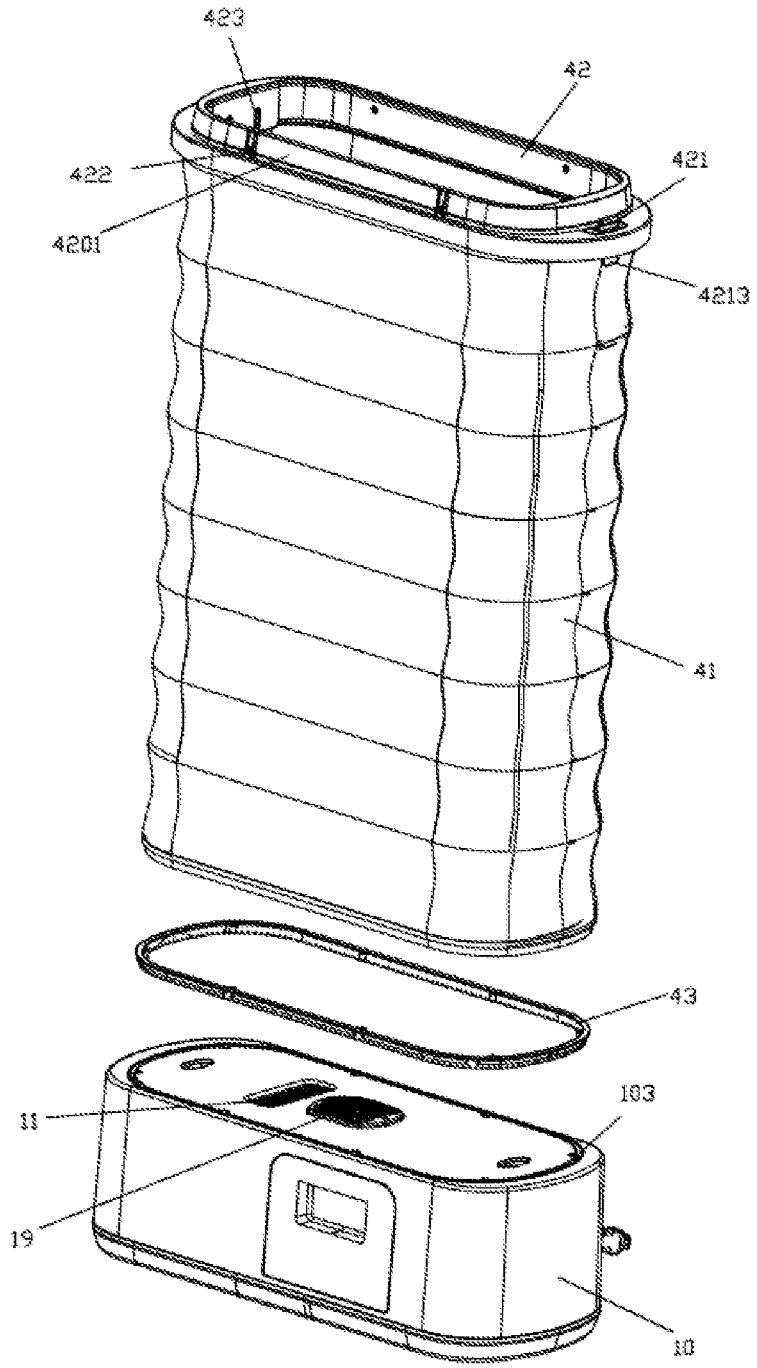
FIG. 6 shows the partial exploded view of the mating structure of the machine base and the cloth cover according to the embodiment.
Figure 7:
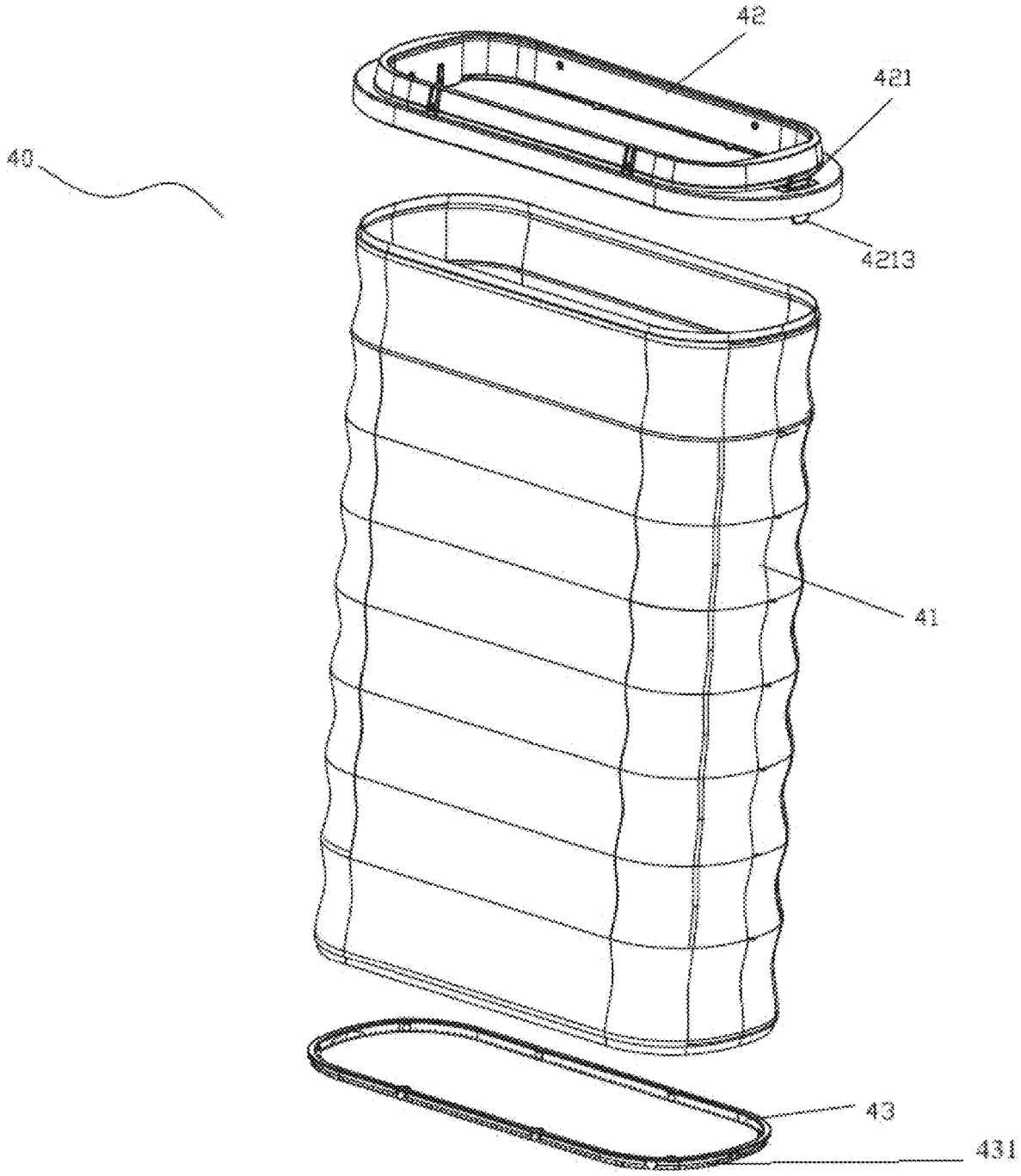
FIG. 7 shows the structural exploded view of the cloth cover according to the embodiment.

Continuing to refer to FIGS. 6 and 7, the cloth cover 40 may include a cloth cover body 41, a lower fixing frame 43 sealed to the lower end of the cloth cover body 41, and an upper fixing frame 42 sealed to the upper end of the cloth cover body 41. The lower fixing frame 43 may be fixedly sealed to the machine base 10, and the upper fixing frame 42 may be detachably connected to the top seat 30. Both the lower fixing frame 43 and the upper fixing frame 42 may be rigid structures, which can well realize the connection with the external structure. The cloth cover body 41 may be a flexible cloth, such that folding can be achieved.

Sealing cooperation between the cloth cover body 41 and the lower fixing frame 43, between the cloth cover body 41 and the upper fixing frame 42, and between the lower fixing frame 43 and the machine base 10 can effectively prevent the steam or hot air in the cavity from flowing out, resulting in waste. Of course, the above-mentioned connection and mating structure may also not need sealing and mating, but the effect will be poor.

The cloth cover body 41 may be formed by connecting a plurality of cloth cover units end to end, and the ports between adjacent cloth cover units may be bent inward and connected by sutures to achieve sealing. Of course, other connection methods can also be adopted for a connection, such as glue bonding, or the like. The end may be bent inwardly, such that the cloth cover body 41 has a multi-layer concave structure, and a regular folded structure can be obtained during folding. The upper end of the uppermost cloth cover unit may be connected to the upper fixing frame 42, and the lower end of the lowermost cloth cover unit may be connected to the lower fixing frame 43, so as to realize stable connection.

Figure 8:
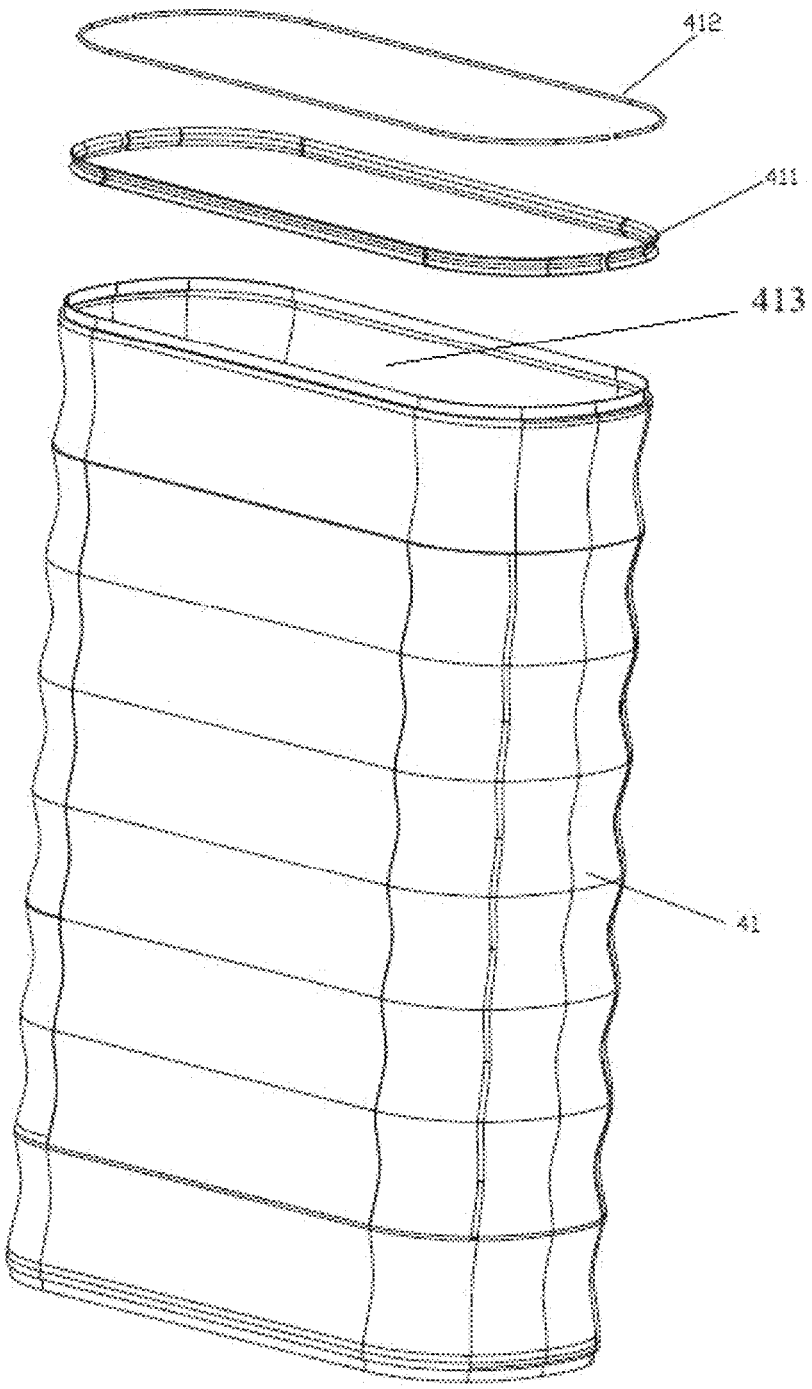
FIG. 8 is an exploded view of a partial structure of the cloth cover body according to the embodiment.

Continuing to refer to FIG. 8, a loop of webbing 411 may be sewn on the inner middle of at least one cloth cover unit, an annular channel 413 may be formed between the webbing 411 and the cloth cover unit, and a support frame 412 may be provided inside the annular channel 413. The support frame 412 plays a role of maintaining the shape and can effectively prevent the cloth cover body 41 from being deformed. In addition, in the whole cloth cover body 41, the inwardly bent ports and the support frame 412 may be alternately provided. When folding, the folding structure is more regular and not easily deformed.

Each cloth cover unit at least includes a waterproof layer on the inner layer and an outer cover layer on the outer layer. The waterproof layer on the inner layer can prevent the penetration of water vapor, and the outer cover layer plays the role of beautifying and protecting the appearance. Of course, other structures, such as a thermal insulation layer, can be added between the waterproof layer and the outer cover layer.

Figure 5:
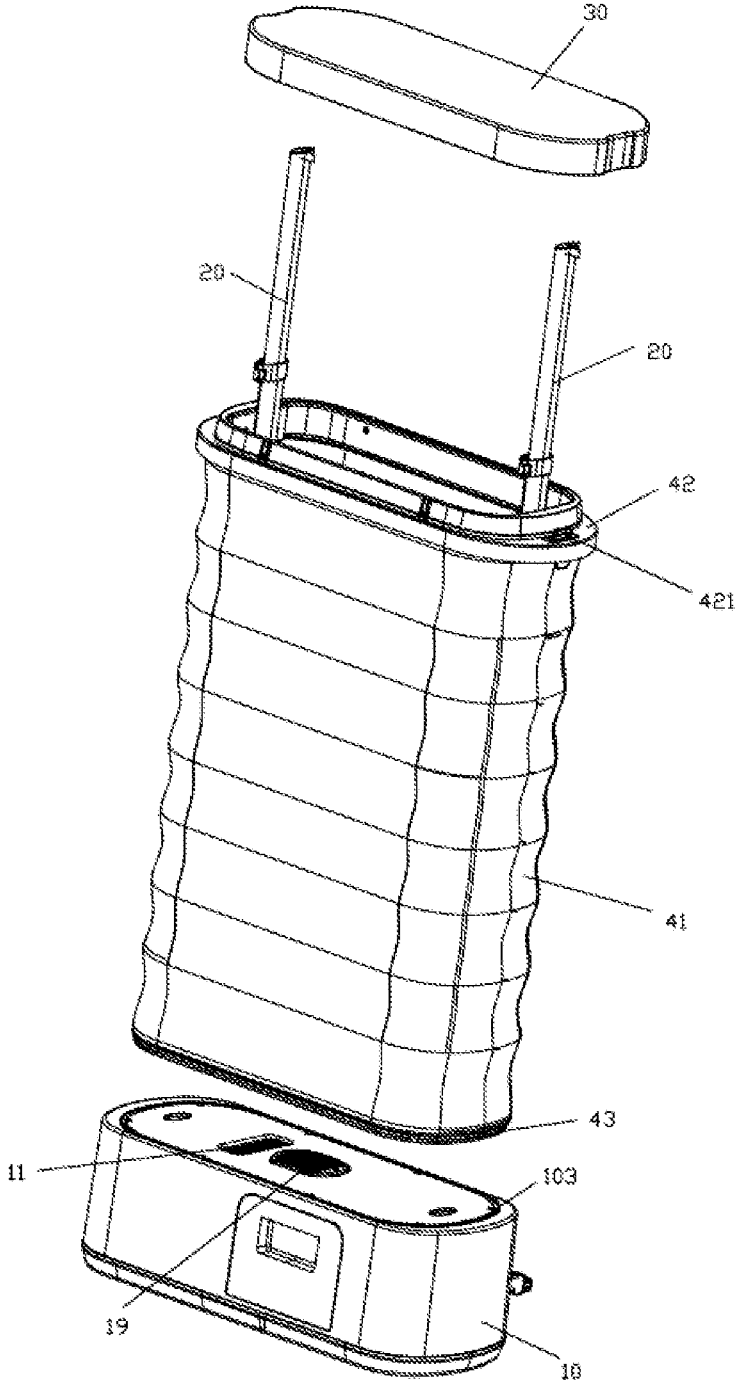
FIG. 5 is an exploded view of a partial structure of the clothing care machine according to the embodiment.

Continuing to refer to FIGS. 5 and 6, an annular positioning groove 103 may be recessed on the machine base 10, an annular convex rib 431 protrudes from the bottom of the lower fixing frame 43, and the annular convex rib 431 of the lower fixing frame 43 is sealed and inserted into the annular positioning groove 103, such that good positioning and sealing can be achieved. The lower fixing frame 43 and the machine base 10 may be also fixedly connected by a fixing piece. Specifically, the fixing piece is a screw lock (such as a bolt), that is, the lower fixing frame 43 and the machine base 10 are provided with corresponding screw holes (not shown) and are then screwed and fixed by screw locks. The structure and the operation are simple, and the disassembly is convenient. Of course, in other embodiments, the arrangement is not limited to this.

The number of the support columns 20 may be two, and the two support columns 20 may be located on the left and right sides, which play a role of uniform support and improve support stability.

The support column 20 may be also provided in the cavity. The upper fixing frame 42 may be provided with a roller 423 on the inner wall corresponding to the support column 20. When the position of the upper fixing frame 42 is shifted during the movement, the friction can be reduced and the action can be smoother due to the roller 423 abutting the support column 20.

Figure 9:
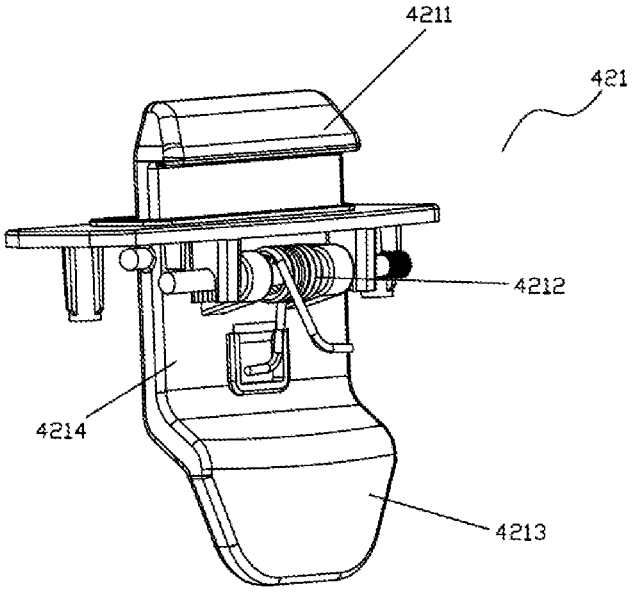
FIG. 9 is a perspective view of the first elastic snap joint in the embodiment.
Figure 10:
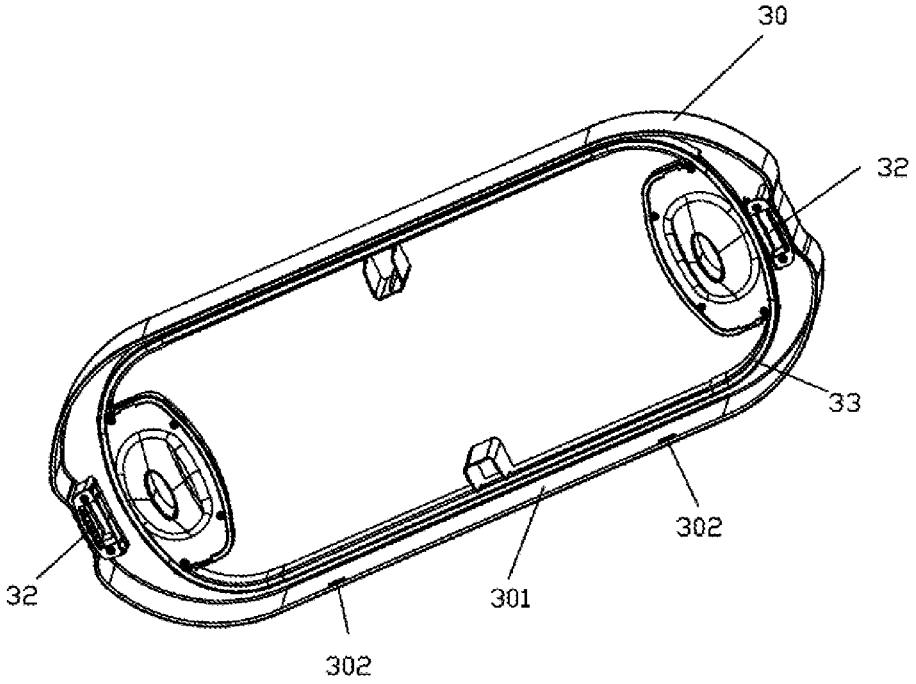
FIG. 10 is a perspective view of the interior of the top seat according to the embodiment.
Figure 11:
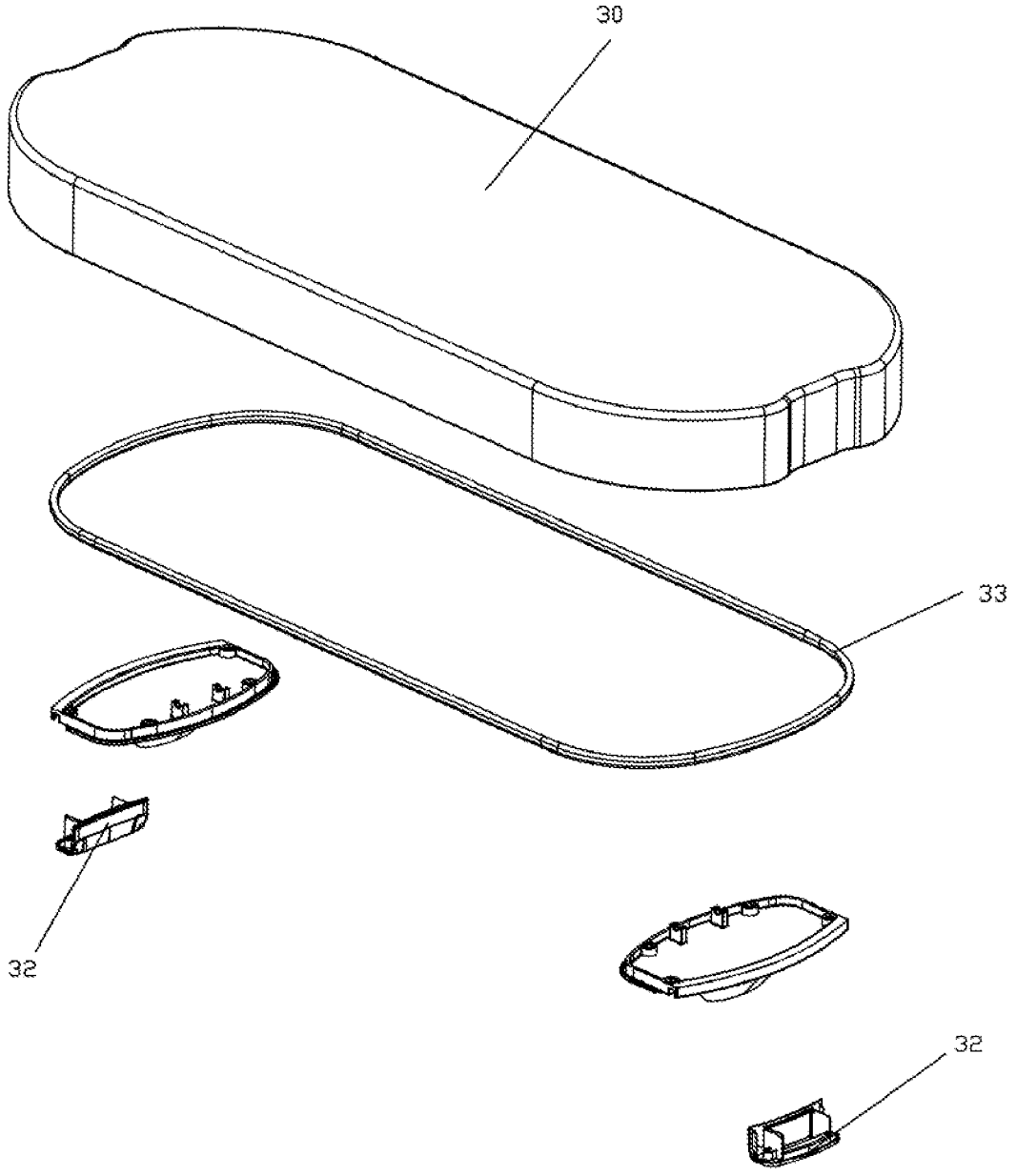
FIG. 11 is an exploded view of the mating structure on the top seat according to embodiment.

Continuing to refer to FIG. 9 to FIG. 11, a detachable connection may be formed between the upper fixing frame 42 and the top seat 30 through a snap connection. One way may be as follows: a plurality of snap joints (such as the first elastic snap joints 421 and the second elastic snap joints 422 described below) may be distributed on the outer periphery of the upper fixing frame 42, and the top seat 30 may be provided with a plurality of snap sockets (such as the first snap sockets 32 and the second snap sockets 302 described below). The upper fixing frame 42 may be clamped on the snap sockets through the snap joints, so as to realize a stable connection in the circumferential direction and uniform force. More specifically, in order to facilitate the operation, among the plurality of snap joints, there are two first elastic snap joints 421 distributed left and right and a plurality of second elastic snap joints 422 distributed on the front and rear sides. The snap sockets mated with the first elastic snap joint 421 are the first snap sockets 32, and the snap sockets mated with the second elastic snap joints 422 are the second snap sockets 302.

The mating surface of the first elastic snap joint 421 and the first snap socket 32 may be a flat surface, and the snapping is more firm. The first elastic snap joint 421 may be further provided with a reset end 4213 extending outward, for driving a trip. When it is necessary to release the snap connection, the external force acts on the reset end, and the first elastic snap joint 421 may be driven to dislocate through the reset end. The mating surface of the second elastic snap joint 422 and the second snap socket 302 may be a guide arc surface, and the mating manner is relatively easy to disengage.

Specifically, as shown in FIG. 9, the first elastic snap joint 421 may include a plate-shaped body 4214 and a torsion spring 4212. The middle of the plate-shaped body 4214 may be provided with a hinge, specifically, hinged on the upper fixing frame 42. The upper end of the plate-shaped body 4214 forms a snap joint portion 4211 mated with the first snap socket 32, and the lower end extends to form a reset end 4213. The torsion spring 4212 acts on the plate-shaped body 4214 to make the snap joint portion 4211 fit with the first snap socket 32.

When separated, the specific operation may be as follows: the operator holds the left and right ends of the upper fixing frame 42 with both hands and then touches the reset end 4213 of the first elastic snap joint 421 with his fingers and exerts force to make the first elastic snap joint 421 dislocate; then a certain downward force is applied, and the second elastic snap joint 422 is disengaged from the second snap socket 302 under the action of the downward external force, so as to realize the separation of the upper fixing frame. The structure is cleverly designed.

Of course, in other embodiments, the detachable connection manner formed between the upper fixing frame 42 and the top seat 30 is not limited to the clamping structure.

Embodiment 2

Referring to FIGS. 1 to 5, the present embodiment provides a clothing care machine, including a machine base 10, a support column 20, a cloth cover 40 and a top seat 30. The bottom of the support column 20 may be connected to the machine base 10, the top seat 30 may be connected to the top of the support column 20, and the cloth cover 40 may be provided between the machine base 10 and the top seat 30 to form a cavity. The machine base 10 may be provided with a steam outlet 11 and a hot air outlet 19 in communication with the cavity. When in use, the clothes are put into the cavity, and the automatic care of the clothes can be realized through the cooperation of the steam output by the steam outlet 11 and the hot air output by the hot air outlet 19 of the machine base 10. Specifically, the combination of the steam output from the steam outlet 11 and the hot air output from the hot air outlet 19 may be independent outputs or alternate outputs (e.g., steam output first, then hot air output, etc.). During the process, the user does not need to operate the whole process, but only needs to put the clothes in and out, which saves time and effort.

Specifically, as shown in FIG. 4, the clothing care machine provided in the present embodiment may have a substantially rectangular shape from a top view. The long side direction is defined as the left-right direction, and the short side direction is defined as the front-rear direction. Of course, in other embodiments, the shape of the clothing care machine is not limited to this.

In the present embodiment, the lower end of the cloth cover 40 may be fixed and sealed to the machine base 10 to prevent leakage, and the upper end of the cloth cover 40 may be detachably connected to the top seat 30. With this arrangement, when it is necessary to take and place clothes, the upper end of the cloth cover 40 can be separated, and the cloth cover 40 can be moved down as a whole, such that the upper space is exposed in all directions without blocking, and the clothes can be taken and placed better, and the operation is easier.

In order to ensure the sealing of the cavity, the upper end of the cloth cover 40 also forms a sealing contact with the top seat 30. Specifically, as shown in FIG. 6 to FIG. 11, the bottom of the top seat 30 may be provided with a rubber tube 33, and the upper end of the cloth cover 40 abuts against and squeezes the rubber tube 33 to form a sealing fit. That is, when the upper end of the cloth cover 40 abuts against the rubber tube 33, because the rubber tube 33 is hollow and has good flexibility, the rubber tube 33 may be deformed by the extrusion of the cloth cover 40, such that the rubber tube 33 can form a good sealing contact with the cloth cover 40. The sealing and mating are good, and the structure is simple.

Specifically, the cloth cover 40 may include a cloth cover body 41, a lower fixing frame 43 sealed to the lower end of the cloth cover body 41, and an upper fixing frame 42 sealed to the upper end of the cloth cover body 41. The lower fixing frame 43 may be fixedly sealed to the machine base 10, and the upper fixing frame 42 may be detachably connected to the top seat 30 and forms a sealing fit with the rubber tube 33. Both the lower fixing frame 43 and the upper fixing frame 42 may be rigid structures, which can well realize the connection with the external structure. The cloth cover body 41 may be a flexible cloth, such that folding can be achieved.

A separable connection may be formed between the upper fixing frame 42 and the top seat 30 through snap connection. One way is as follows: a plurality of snap joints (such as the first elastic snap joints 421 and the second elastic snap joints 422 described below) may be distributed on the outer periphery of the upper fixing frame 42, and the top seat 30 may be provided with a plurality of snap sockets (such as the first snap sockets 32 and the second snap sockets 302 described below). The upper fixing frame 42 may be clamped on the snap sockets through the snap joints, so as to realize a stable connection in the circumferential direction and uniform force. More specifically, in order to facilitate the operation, among the plurality of snap joints, there are two first elastic snap joints 421 distributed left and right and a plurality of second elastic snap joints 422 distributed on the front and rear sides. The snap sockets mated with the first elastic snap joint 421 are the first snap sockets 32, and the snap sockets mated with the second elastic snap joints 422 are the second snap sockets 302.

The mating surface of the first elastic snap joint 421 and the first snap socket 32 may be a flat surface, and the snapping is more firm. The first elastic snap joint 421 may be provided with a reset end 4213 extending outward, for driving a trip. When it is necessary to release the snap connection, the external force acts on the reset end, and the first elastic snap joint 421 may be driven to dislocate through the reset end. The mating surface of the second elastic snap joint 422 and the second snap socket 302 may be a guide arc surface, and the mating manner is relatively easy to disengage.

Specifically, as shown in FIG. 9, the first elastic snap joint 421 may include a plate-shaped body 4214 and a torsion spring 4212. The middle of the plate-shaped body 4214 may be provided with a hinge, specifically, hinged on the upper fixing frame 42. The upper end of the plate-shaped body 4214 forms a snap joint portion 4211 mated with the first snap socket 32, and the lower end extends to form a reset end 4213. The torsion spring 4212 acts on the plate-shaped body 4214 to make the snap joint portion 4211 fit with the first snap socket 32.

When separated, the specific operation may be as follows: the operator holds the left and right ends of the upper fixing frame 42 with both hands, and then touches the reset end 4213 of the first elastic snap joint 421 with his fingers and exerts force to make the first elastic snap joint 421 dislocate; then a certain downward force is applied, and the second elastic snap joint 422 is disengaged from the second snap socket 302 under the action of the downward external force, so as to realize the separation of the upper fixing frame 42. The structure is cleverly designed.

Of course, in other embodiments, the detachable connection manner formed between the upper fixing frame 42 and the top seat 30 is not limited to the clamping structure.

As shown in FIG. 10, the bottom of the top seat 30 has an abutting inner wall 301 of which aperture gradually increases from top to bottom. As shown in FIG. 6, the upper fixing frame 42 has an outer peripheral mating surface 4201 whose outer diameter gradually increases from top to bottom. When the upper fixing frame 42 moves upward for mating, the abutting inner wall 301 may be mated with the outer periphery. The mating of the surfaces 4201 will play a guiding role, making the mating more precise. When the upper fixing frame 42 is connected to the top seat 30, the outer peripheral mating surface 4201 may be attached to the abutting inner wall 301 of the top seat 30 to increase the contact area and further improve the sealing performance. Of course, it is not limited to this in other embodiments.

Embodiment 3

Referring to FIGS. 1 to 5, the present embodiment provides a clothing care machine, including a machine base 10, a support column 20, a cloth cover 40 and a top seat 30. The bottom of the support column 20 may be connected to the machine base 10, the top seat 30 may be connected to the top of the support column 20, and the cloth cover 40 may be provided between the machine base 10 and the top seat 30 to formed a cavity. The machine base 10 may be provided with a steam outlet 11 and a hot air outlet 19 communicating with the cavity. When in use, the clothes are put into the cavity, and the automatic care of the clothes can be realized through the cooperation of the steam output by the steam outlet 11 and the hot air output by the hot air outlet 19 of the machine base 10. Specifically, the combination of the steam output from the steam outlet 11 and the hot air output from the hot air outlet 19 may be independent outputs or alternate outputs (e.g., steam output first, then hot air output, etc.). During the process, the user does not need to operate the whole process, but only needs to put the clothes in and out, which saves time and effort.

The number of the support columns 20 may be two, and the two support columns 20 may be located on the left and right sides, which play a role of uniform support and improve support stability. Of course, in other embodiments, the number of the support columns 20 is not limited to this.

In the present embodiment, the lower end of the cloth cover 40 may be fixed and sealed to the machine base 10 to prevent leakage, and the upper end of the cloth cover 40 may be detachably connected to the top seat 30. With this arrangement, when it is necessary to take and place clothes, the upper end of the cloth cover 40 can be separated, and the cloth cover 40 can be moved down as a whole, such that the upper space is exposed in all directions without blocking, and the clothes can be taken and placed better, and the operation is easier.

Continuing to refer to FIGS. 6 to 8, the cloth cover 40 may include a cloth cover body 41, a lower fixing frame 43 sealed to the lower end of the cloth cover body 41, and an upper fixing frame 42 sealed to the upper end of the cloth cover body 41. The lower fixing frame 43 may be fixedly sealed to the machine base 10, and the upper fixing frame 42 may be detachably connected to the top seat 30. Both the lower fixing frame 43 and the upper fixing frame 42 may be rigid structures, which can well realize the connection with the external structure. The cloth cover body 41 may be a flexible cloth, such that folding can be achieved.

Sealing cooperation between the cloth cover body 41 and the lower fixing frame 43, between the cloth cover body 41 and the upper fixing frame 42, and between the lower fixing frame 43 and the machine base 10 can effectively prevent the steam or hot air in the cavity from flowing out, resulting in waste. Of course, the above-mentioned connection and mating structure may also not need sealing and mating, but the effect will be poor.

The cloth cover body 41 may be formed by connecting a plurality of cloth cover units end to end, and the ports between adjacent cloth cover units may be bent inward and connected by sutures to achieve sealing. Of course, other connection methods can also be adopted for a connection, such as glue bonding, or the like. The end may be bent inwardly, such that the cloth cover body 41 has a multi-layer concave structure, and a regular folded structure can be obtained during folding. The upper end of the uppermost cloth cover unit may be connected to the upper fixing frame 42, and the lower end of the lowermost cloth cover unit may be connected to the lower fixing frame 43, so as to realize a stable connection.

A loop of webbing 411 may be sewn on the inner middle of at least one cloth cover unit, an annular channel 413 may be formed between the webbing 411 and the cloth cover unit, and a support frame 412 may be provided inside the annular channel 413. The support frame 412 plays a role of maintaining the shape and can effectively prevent the cloth cover body 41 from being deformed. In addition, in the whole cloth cover body 41, the inwardly bent ports and the support frame 412 may be alternately provided. When folding, the folding structure is more regular and not easily deformed.

Each cloth cover unit at least includes a waterproof layer on the inner layer and an outer cover layer on the outer layer. The waterproof layer on the inner layer can prevent the penetration of water vapor, and the outer cover layer plays the role of beautifying and protecting the appearance. Of course, other structures, such as a thermal insulation layer, can be added between the waterproof layer and the outer cover layer.

An annular positioning groove 103 may be recessed on the machine base 10, an annular rib (not shown) protrudes from the bottom of the lower fixing frame 43, and the annular rib of the lower fixing frame 43 is sealed and inserted into the annular positioning groove 103, such that good positioning and sealing can be achieved. The lower fixing frame 43 and the machine base 10 may be also fixedly connected by a fixing piece. Specifically, the fixing piece is a screw lock (such as a bolt), that is, the lower fixing frame 43 and the machine base 10 are provided with corresponding screw holes (not shown), and the lower fixing frame 43 and the machine base 10 are then screwed and fixed by screw locks. The structure and the operation are simple, and the disassembly is convenient. Of course, in other embodiments, it is not limited to this.

The support column 20 may be also provided in the cavity. The upper fixing frame 42 may be provided with a roller 423 on the inner wall corresponding to the support column 20. When the position of the upper fixing frame 42 is shifted during the movement, the friction can be reduced and the action can be smoother due to the roller 423 abutting the support column 20.

Continuing to refer to FIG. 9 to FIG. 11, a detachable connection may be formed between the upper fixing frame 42 and the top seat 30 through a snap connection. One way may be as follows: a plurality of snap joints (such as the first elastic snap joints 421 and the second elastic snap joints 422 described below) may be distributed on the outer periphery of the upper fixing frame 42, and the top seat 30 may be provided with a plurality of snap sockets (such as the first snap sockets 32 and the second snap sockets 302 described below). The upper fixing frame 42 may be clamped on the snap sockets through the snap joints, so as to realize a stable connection in the circumferential direction and uniform force. More specifically, in order to facilitate the operation, among the plurality of snap joints, there are two first elastic snap joints 421 distributed left and right and a plurality of second elastic snap joints 422 distributed on the front and rear sides. The snap sockets mated with the first elastic snap joints 421 are the first snap sockets 32, and the snap sockets mated with the second elastic snap joints 422 are the second snap sockets 302.

The mating surface of the first elastic snap joint 421 and the first snap socket 32 may be a flat surface, and the snapping is more firm. The first elastic snap joint 421 may be further provided with a reset end 4213 extending outward, for driving a trip. When it is necessary to release the snap connection, the external force acts on the reset end, and the first elastic snap joint 421 may be driven to dislocate through the reset end. The mating surface of the second elastic snap joint 422 and the second snap socket 302 may be a guide arc surface, and the mating manner is relatively easy to disengage.

Specifically, as shown in FIG. 9, the first elastic snap joint 421 may include a plate-shaped body 4214 and a torsion spring 4212. The middle of the plate-shaped body 4214 may be provided with a hinge, specifically, hinged on the upper fixing frame 42. The upper end of the plate-shaped body 4214 forms a snap joint portion 4211 mated with the first snap socket 32, and the lower end extends to form a reset end 4213. The torsion spring 4212 acts on the plate-shaped body 4214 to make the snap joint portion 4211 fit with the first snap socket 32.

When separated, the specific operation may be as follows: the operator holds the left and right ends of the upper fixing frame 42 with both hands, and then touches the reset end 4213 of the first elastic snap joint 421 with his fingers (such as ring and little fingers) and exerts force to make the first elastic snap joint 421 dislocate; then a certain downward force is applied, and the second elastic snap joint 422 is disengaged from the second snap socket 302 under the action of the downward external force, so as to realize the separation of the upper fixing frame. The structure is cleverly designed.

Of course, in other embodiments, the detachable connection manner formed between the upper fixing frame 42 and the top seat 30 is not limited to the clamping structure.

In order to ensure the sealing of the cavity, the upper end of the cloth cover 40 also forms a sealing contact with the top seat 30. Specifically, the bottom of the top seat 30 may be provided with a rubber tube 33, and the upper end of the cloth cover 40 abuts against and squeezes the rubber tube 33 to form a sealing fit. That is, when the upper end of the cloth cover 40 abuts against the rubber tube 33, because the rubber tube 33 is hollow and has good flexibility, the rubber tube 33 may be deformed by the extrusion of the cloth cover 40, such that the rubber tube 33 can form a good sealing contact with the cloth cover 40. The sealing and mating are good, and the structure is simple.

As shown in FIG. 10, the bottom of the top seat 30 has an abutting inner wall 301 whose aperture gradually increases from top to bottom. As shown in FIG. 6, the upper fixing frame 42 has an outer peripheral mating surface 4201 whose outer diameter gradually increases from top to bottom. When the upper fixing frame 42 moves upward for mating, the abutting inner wall 301 may be mated with the outer periphery. The mating of the surfaces 4201 will play a guiding role, making the mating more precise. When the upper fixing frame 42 is connected to the top seat 30, the outer peripheral mating surface 4201 may be attached to the abutting inner wall 301 of the top seat 30 to increase the contact area and further improve the sealing performance. Of course, the arrangement is not limited to this in other embodiments.

Embodiment 4

The structure of a clothing care machine provided in the present embodiment is substantially the same as that of Embodiment 1 or Embodiment 2 or Embodiment 3, the difference is that in the present embodiment, the machine base is only provided with a steam outlet.

Embodiment 5

The structure of a clothing care machine provided in the present embodiment is substantially the same as that of the fourth embodiment, except that in the present embodiment, only the hot air outlet is provided on the machine base.

Embodiment 6

The structure of a clothing care machine provided in the present embodiment is substantially the same as that of Embodiment 1 or Embodiment 2 or Embodiment 3, the difference is that in the present embodiment, the lower end of the cloth cover is detachably connected to the machine base. The upper end of the cloth cover is detachably connected to the top seat. The upper and lower ends of the cloth cover are separable and can be operated according to actual needs. Specifically, the detachable connection modes may refer to the above-mentioned clamping mode or may be realized by adopting other structures.

Although the present disclosure has been particularly shown and described in connection with preferred embodiments, it will be understood by those skilled in the art that various changes in form and detail made to the present disclosure without departing from the spirit and scope of the present disclosure as defined by the appended claims all fall within the protection scope of the present disclosure.

What is claimed is:

1. A clothing care machine, comprising a machine base, a support column, a cloth cover and a top seat, wherein a bottom of the support column is connected to the machine base, the top seat is connected to a top of the support column, the cloth cover is provided between the machine base and the top seat to form a cavity, and the machine base is provided with at least one of a steam outlet or a hot air outlet;

wherein a lower end of the cloth cover is fixed and sealed to, or detachably connected to, the machine base and an upper end of the cloth cover is detachably connected to the top seat;

wherein the cloth cover comprises a cloth cover body, a lower fixing frame connected to a lower end of the cloth cover body, and an upper fixing frame connected to an upper end of the cloth cover body, the lower fixing frame is fixedly connected to the machine base, and the upper fixing frame is detachably connected to the top seat;

wherein the cloth cover body is formed by connecting a plurality of cloth cover units end to end, each end between adjacent cloth cover units of the plurality of cloth cover units is bent inward to form a connection, an upper end of an uppermost cloth cover unit of the plurality of cloth cover units is connected to the upper fixing frame, and a lower end of a lowermost cloth cover unit of the plurality of cloth cover units is connected to the lower fixing frame; and wherein at least one of the plurality of cloth cover units is sewn with a loop of webbing at a middle inside, an annular channel is formed between the loop of webbing and the at least one of the plurality of cloth cover units, and the annular channel is provided with a support frame.

2. The clothing care machine according to claim 1, wherein an outer periphery of the upper fixing frame is distributed with a plurality of snap joints, the top seat is provided with a plurality of snap sockets, and the upper fixing frame is clamped on the plurality of snap sockets through the plurality of snap joints.

3. The clothing care machine according to claim 2, wherein, in the plurality of snap joints, two first elastic snap joints distributed left and right and a plurality of second elastic snap joints distributed front and rear are included, a mating surface of each of the two first elastic snap joints and each of the plurality of snap sockets is a flat surface, each of the two first elastic snap joints is further provided with a reset end extending outward for driving a trip, and a mating surface of each of the plurality of second elastic snap joints and the each of the plurality of snap sockets is a guide arc surface.

4. The clothing care machine according to claim 1, wherein a bottom of the top seat is provided with a rubber tube, and the upper end of the cloth cover abuts and squeezes the rubber tube to form a sealing fit.

5. The clothing care machine according to claim 4, wherein the upper fixing frame forms a sealing fit with the rubber tube.

6. The clothing care machine according to claim 5, wherein the upper fixing frame is distributed with a plurality of snap joints on an outer periphery of the upper fixing frame, the top seat is provided with a plurality of snap sockets, and the upper fixing frame is clamped on the plurality of snap sockets through the plurality of snap joints.

7. The clothing care machine according to claim 5, wherein the bottom of the top seat has an abutting inner wall with a gradually increasing aperture from top to bottom, the upper fixing frame has an outer peripheral mating surface with a gradually increasing aperture from top to bottom, and when the upper fixing frame is connected with the top seat, the outer peripheral mating surface of the upper fixing frame is abutted on the abutting inner wall of the top seat.

8. A clothing care machine, comprising a machine base, a support column, a cloth cover and a top seat, wherein a bottom of the support column is connected to the machine base, the top seat is connected to a top of the support column, the cloth cover is provided between the machine base and the top seat to form a cavity, and the machine base is provided with at least one of a steam outlet or a hot air outlet;

wherein a lower end of the cloth cover is fixed and sealed to, or detachably connected to, the machine base and an upper end of the cloth cover is detachably connected to the top seat;

wherein the cloth cover comprises a cloth cover body, a lower fixing frame connected to a lower end of the cloth cover body, and an upper fixing frame connected to an upper end of the cloth cover body, the lower fixing frame is fixedly connected to the machine base, and the upper fixing frame is detachably connected to the top seat; and wherein the machine base is recessed with an annular positioning groove, an annular convex rib protrudes from a bottom of the lower fixing frame, the annular convex rib of the lower fixing frame is sealed and disposed in the annular positioning groove, and a fixed connection is also realized between the lower fixing frame and the machine base through a fixing piece.

9. A clothing care machine, comprising a machine base, a support column, a cloth cover and a top seat, wherein a bottom of the support column is connected to the machine base, the top seat is connected to a top of the support column, the cloth cover is provided between the machine base and the top seat to form a cavity, and the machine base is provided with at least one of a steam outlet or a hot air outlet;

wherein a lower end of the cloth cover is fixed and sealed to, or detachably connected to, the machine base and an upper end of the cloth cover is detachably connected to the top seat;

wherein the cloth cover comprises a cloth cover body, a lower fixing frame connected to a lower end of the cloth cover body, and an upper fixing frame connected to an upper end of the cloth cover body, the lower fixing frame is fixedly connected to the machine base, and the upper fixing frame is detachably connected to the top seat; and wherein the support column is also provided in the cavity, and the upper fixing frame is provided with a roller on an inner wall of the support column.

* * * * *